US009004213B2

(12) United States Patent
Larson et al.

(10) Patent No.: US 9,004,213 B2
(45) Date of Patent: Apr. 14, 2015

(54) ELECTRIC MOTORIZED SKATEBOARD WITH AN ACTUATOR ASSEMBLY WITH A FOOTPAD AND FORCE SENSOR

(71) Applicant: Intuitive Motion, Inc., Modesto, CA (US)

(72) Inventors: Geoff Ellis Larson, Sacramento, CA (US); Benjamin Swanberg Forman, San Francisco, CA (US)

(73) Assignee: Intuitive Motion, Inc.

( * ) Notice: Subject to any disclaimer, the term of this patent is extended or adjusted under 35 U.S.C. 154(b) by 0 days.

(21) Appl. No.: 13/764,630

(22) Filed: Feb. 11, 2013

(65) Prior Publication Data

US 2013/0206493 A1 Aug. 15, 2013

Related U.S. Application Data

(60) Provisional application No. 61/597,408, filed on Feb. 10, 2012.

(51) Int. Cl.
*A63C 17/12* (2006.01)
*A63C 17/01* (2006.01)

(52) U.S. Cl.
CPC ..... *A63C 17/12* (2013.01); *A63C 17/012* (2013.01)

(58) Field of Classification Search
CPC ..... A63C 17/12; A63C 17/012
USPC ..... 180/181; 701/22
See application file for complete search history.

(56) References Cited

U.S. PATENT DOCUMENTS

| | | | | |
|---|---|---|---|---|
| 5,487,441 | A * | 1/1996 | Endo et al. | 180/181 |
| 6,050,357 | A | 4/2000 | Staelin et al. | |
| 6,796,394 | B1 * | 9/2004 | Lin | 180/181 |
| 7,138,774 | B2 | 11/2006 | Negoro et al. | |
| 7,198,280 | B2 | 4/2007 | Hara | |
| 2004/0262056 | A1 * | 12/2004 | Ying | 180/65.1 |
| 2005/0139406 | A1 * | 6/2005 | McLeese | 180/180 |
| 2012/0232734 | A1 * | 9/2012 | Pelletier | 701/22 |
| 2013/0081891 | A1 * | 4/2013 | Ulmen et al. | 180/181 |

OTHER PUBLICATIONS

Thomas, Shane, PCT Notification of Transmittal of the International Search Report and the Written Opinion of the International Searching Authority or the Declaration, Apr. 26, 2013, pp. 1-9.

(Continued)

*Primary Examiner* — Brodie Follman
*Assistant Examiner* — Brian Cassidy
(74) *Attorney, Agent, or Firm* — Stetina Brunda Garred & Brucker

(57) ABSTRACT

There is provided an electric motorized skateboard. The skateboard includes a skateboard deck and wheels. The skateboard includes a first actuator with a footpad and a force sensor. The footpad is generally disposed at a deck top surface. The footpad and the force sensor are cooperatively sized and configured to translate force applied to the footpad to the force sensor. The force sensor is sized and configured to output a sensed signal in response to application of force upon the force sensor. The skateboard includes a controller in electrical communication with the force sensor. The controller receives the sensed signal and generates a motor input signal in response to the sensed signal. The skateboard includes an electric motor in mechanical communication with at least one of the wheels. The motor has a variable electric motor output in response to a value of a motor input signal.

15 Claims, 7 Drawing Sheets

(56) References Cited

OTHER PUBLICATIONS

Interlink Electronics, Force Sensing Resistor Integration Guide and Evaluation of Parts Catalog, pp. 1-26.
Interlink Electronics, FSR 406 Data Sheet, pp. 1-4.
Interlink Electronics, FSR 400 Series Data Sheet, pp. 1-9.

* cited by examiner

ELECTRIC MOTORIZED SKATEBOARD WITH AN ACTUATOR ASSEMBLY WITH A FOOTPAD AND FORCE SENSOR

CROSS-REFERENCE TO RELATED APPLICATIONS

This application claims the benefit of U.S. Provisional Application No. 61/597,408, filed Feb. 10, 2012, the contents of which are expressly incorporated herein by reference.

STATEMENT RE: FEDERALLY SPONSORED RESEARCH/DEVELOPMENT

Not Applicable

BACKGROUND

1. Technical Field of the Invention

The present invention relates generally to an electric motorized skateboard, and more specifically to an electric motorized skateboard with an actuator assembly with a footpad and force sensor.

2. Description of the Related Art

Electric motorized skateboards have gained popularity, ranging from casual commuter riders to those in the extreme end of the action sports community. Contemporary electric motorized skateboard are typically powered by a DC battery powered motor that is mourned to the underside of a skateboard deck. The output shaft is mechanically linked to a selected one of the rear pair of wheels. A handheld input device is provided that is configured to generate an input acceleration signal for transmission to an on-board controller through a wired or wireless connection. The handheld input device may include a trigger like actuator that may be used for generating the input acceleration signal that results in the energizing of the electric motor for desired forward movement of the skateboard. However, the use of a handheld input device requires the rider to associate a linger trigger reflex with desired acceleration. Such hand coordinated control is neither intuitive nor a natural reflex in comparison to those movements associate with non-powered skateboarding techniques.

Therefore, there is a need in the art for an improved electric motorized skateboard in comparison to the prior art. Various aspects of the present invention address these particular needs, as will be discussed in more detail below.

BRIEF SUMMARY

There is provided art electric motorized skateboard. The electric motorized skateboard further includes a skateboard deck having a deck top surface and an opposing deck bottom surface. The electric motorized skateboard further includes a plurality of skateboard wheels disposed adjacent to the deck bottom surface. The electric motorized skateboard further includes a first actuator assembly attached to the skateboard deck. The first actuator assembly includes a footpad and a force sensor. The footpad is generally disposed at the deck top surface. The footpad and the force sensor are cooperatively sized and configured to translate force applied to the footpad to the force sensor. The force sensor is sized and configured to output a sensed signal in response to application of force upon the force sensor. The electric motorized skateboard further includes a controller in electrical communication with the force sensor. The controller is sized and configured to receive the sensed signal and generate a motor input signal in response to the sensed signal. The electric motorized skateboard further includes an electric motor in mechanical communication with at least one of the skateboard wheels. The electric motor has a variable electric motor output in response to a value of a motor input signal received from the controller.

According to various embodiments, a force sensor may include force-sensing resistors. The footpad and the force-sensing resistors may be cooperatively sized and configured to translate force applied to the footpad to the force-sensing resistors. The force sensor is sized and configured to output a sensed signal in response to application of force upon the force-sensing resistors. The electric motor may be a DC motor, and the motor input signal may be a variable voltage signal. The footpad may include a substantially flat foot pad surface, and the footpad surface is generally parallel with the deck top surface. Alternatively, the footpad surface is disposed at an angle with respect to the deck top surface. The skateboard deck has a skateboard front end and a skateboard rear end, and the footpad surface may taper away from the deck top surface towards the skateboard front end.

Further, the electric motorized skateboard may include a second actuator assembly attached to the skateboard deck. The second actuator assembly includes a footpad and a force sensor, and the footpad is generally disposed at the deck top surface. The force sensor includes force-sensing resistors, and the footpad and the force-sensing resistors are cooperatively sized and configured to translate force applied to the footpad to the force-sensing resistors, the force sensor is sized and configured to output a sensed signal in response to application of force upon the force-sensing resistors. The controller is in electrical communication with the force sensor of the second actuator assembly, and the controller is sized and configured to receive the sensed signal from the second actuator assembly and generate a motor input signal in response to the sensed signals of the first and second actuator assemblies. The first actuator assembly may be disposed between the second actuator assembly and the skateboard front end, and the second actuator assembly may be disposed between the first actuator assembly and the skateboard rear end.

According to further embodiments, the plurality of skateboard wheels includes a pair of front skateboard wheels, and the motorized skateboard may further include a skateboard truck with the front skateboard wheels attached to the skateboard truck, the skateboard truck is attached to the first actuator assembly. The controller may be configured to store at least two rider profiles, the controller is sized and configured to generate a motor input signal using a selected rider profile and the sensed signal. The electric motorized skateboard may include multiple motors. In this regard, the electric motor may be a first electric motor, and the electric motorized skateboard may further include a second electric motor in mechanical communication with at least another one of the skateboard wheels. The second electric motor has a variable electric motor output in response to a value of a motor input signal received from the controller. The controller may be sized and configured to receive the sensed signal and respectively generate first and second motor input signals in response to the sensed signal, and the first electric motor may be configured to receive the first motor input signal, the second electric motor is configured to receive the second motor input signal.

There is provided an electric motorized skateboard. The electric motorized skateboard further includes a skateboard deck having a deck top surface and an opposing deck bottom surface. The electric motorized skateboard further includes a plurality of skateboard wheels disposed adjacent to the deck bottom surface. The electric motorized skateboard further includes a first actuator assembly attached to the skateboard deck. The first actuator assembly includes a footpad and a force sensor. The force sensor includes force-sensing resistors. The footpad is generally disposed at the deck top surface, the footpad and the force-sensing resistors being cooperatively sized and configured to translate force applied to the footpad to the force-sensing resistors. The force sensor is sized and configured to output a sensed signal in response to the application of force upon the force-sensing resistors. The electric motorized skateboard further includes a controller in electrical communication with the force sensor. The controller is sized and configured to receive the sensed signal and generate a motor input signal in response to the sensed signal. The electric motorized skateboard further includes an electric motor in mechanical communication with at least one of the skateboard wheels. The electric motor has a variable electric motor output in response to a value of a motor input signal received from the controller.

According to another embodiment, there is provided an electric motorized skateboard. The electric motorized skateboard includes a skateboard deck having a deck top surface and an opposing deck bottom surface. The electric motorized skateboard further includes a plurality of skateboard wheels disposed adjacent to the deck bottom surface. The electric motorized skateboard further includes an acceleration actuator assembly attached to the skateboard deck. The acceleration actuator assembly includes a footpad and a force sensor. The footpad is generally disposed at the deck top surface. The footpad and the force sensor are cooperatively sized and configured to translate force applied to the footpad to the force sensor. The force sensor is sized and configured to output a sensed acceleration signal in response to application of force upon the force sensor. The electric motorized skateboard further includes a deceleration actuator assembly attached to the skateboard deck. The deceleration actuator assembly includes a footpad and a force sensor. The footpad is generally disposed at the deck top surface. The footpad and the force sensor are cooperatively sized and configured to translate force applied to the footpad to the force sensor. The force sensor is sized and configured to output a sensed deceleration signal in response to application of force upon the force sensor. The electric motorized skateboard further includes a controller in electrical communication with the force sensors. The controller is sized and configured to receive the sensed acceleration signal and the sensed deceleration signal and generate a motor input signal in response to the sensed acceleration signal and the sensed deceleration signal. The electric motorized skateboard further includes an electric motor in mechanical communication with at least one of the skateboard wheels. The electric motor has a variable electric motor output in response to a value of a motor input signal received from the controller. The skateboard deck has a front end and a rear end. The acceleration actuator may be disposed between the deceleration actuator and the front end, and the deceleration actuator may be disposed between the acceleration actuator and the rear end.

The present invention is best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which like numbers refer to like parts throughout, and in which:

FIG. 8(*b*) is a symbolic illustration of a rider upon the electric motorized skateboard of FIG. 8(*a*) with the rider center of mass in a neutral position;

FIG. 8(*c*) is a symbolic illustration of a rider upon the electric motorized skateboard of FIG. 8(*a*) with the rider center of mass shifted rearward;

Common reference numerals are used throughout the drawings and detailed description to indicate like elements.

DETAILED DESCRIPTION

The detailed description set forth below is intended as a description of the presently preferred embodiment of the invention, and is not intended to represent the only form in which the present invention may be constructed or utilized. The description sets forth the functions and sequences of steps for constructing and operating the invention. It is to be understood, however, that the same or equivalent functions and sequences may be accomplished by different embodiments and that they are also intended to be encompassed within the scope of the invention.

Figure 1:
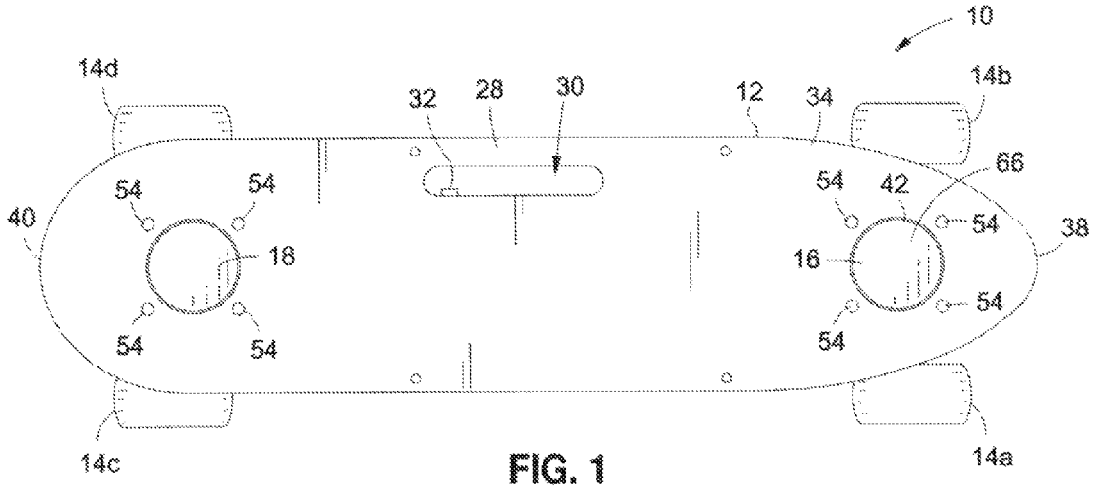
FIG. 1 is a top view of an embodiment of an electric motorized skateboard.
Figure 2:
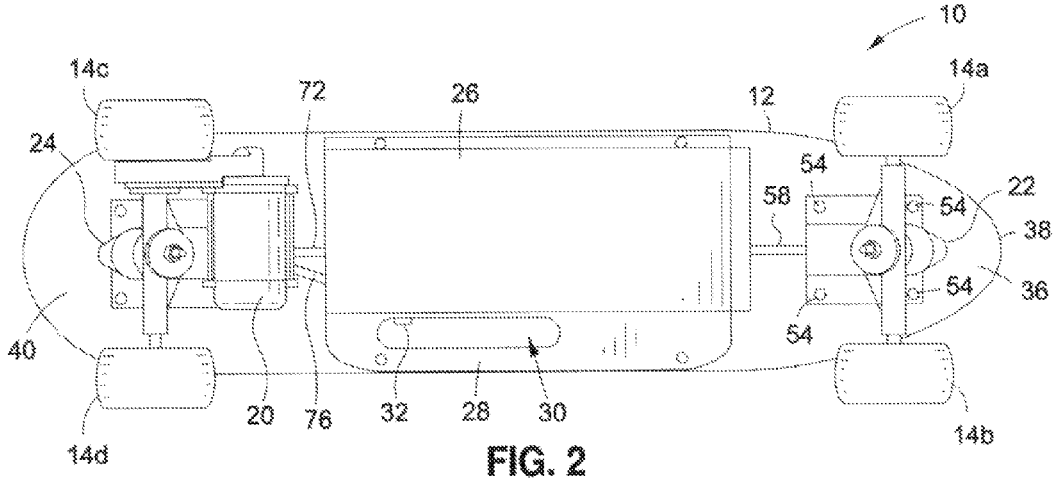
FIG. 2 is a bottom view of the skateboard of FIG. 1.
Figure 3:
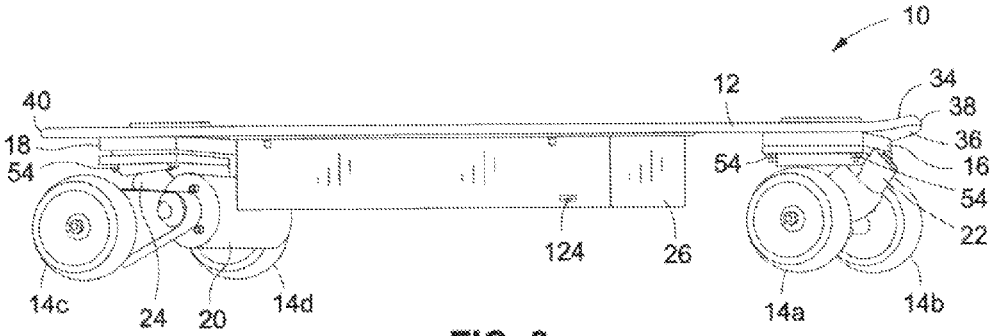
FIG. 3 is a side perspective view of the skateboard of FIG. 1.

Referring now to the drawings, wherein the showings are for purposes of illustrating preferred embodiments of the present invention only, and are not for purposes of limiting the same. FIGS. 1-3 generally depict an embodiment of an electric motorized skateboard 10. FIG. 1 is a top view of an embodiment of the electric motorized skateboard 10. FIG. 2 is a bottom view of the electric motorized skateboard 10 of FIG. 1, and FIG. 3 is a side perspective view of the electric motorized skateboard 10 of FIG. 1.

In this embodiment, the electric motorized skateboard 10 includes a skateboard deck 12 and skateboard wheels 14*a-d*. As will be discussed in further detail below, the electric motorized skateboard 10 includes a first actuator assembly 16 and a second actuator assembly 18. The first and second actuator assemblies 16, 18 are attached to the electric motorized skateboard 10 through the skateboard deck 12. A truck assembly 22 is provided that supports the skateboard wheels

14*a-b*. A truck assembly 24 is provided that supports the skateboard wheels 14*c-d*. The skateboard deck 12 includes a deck top surface 34 and an opposing deck bottom surface 36. The skateboard deck 12 further includes a skateboard front end 38 and an opposing skateboard rear end 40. The electric motorized skateboard 10 includes a housing 26. In this regard, additionally referring to FIG. 9 there is depicted a symbolic schematic of the electric motorized skateboard 10. The housing 26 is a protective structure that houses a controller 68 and battery 70. The electric motorized skateboard 10 further includes an electric motor 20. As will be discussed below, the electric motor 20 is configured in electrical communication with the first and second actuator assemblies 16, 18 and is powered by battery 70 through the controller 68. The electric motor 20 is disposed in mechanical communication with the skateboard wheel 14*c*. As one of ordinary skill in the art can appreciate, such mechanical communication may take the form of any number of configurations that may include use of gears, linkages, drive belt or chain, and the like.

Figure 4:
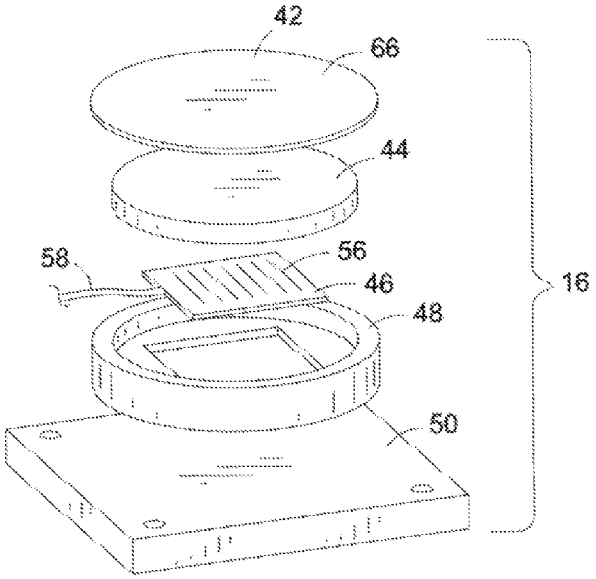
FIG. 4 is an exploded perspective view of an actuator assembly of the skateboard of FIG. 1.
Figure 5:
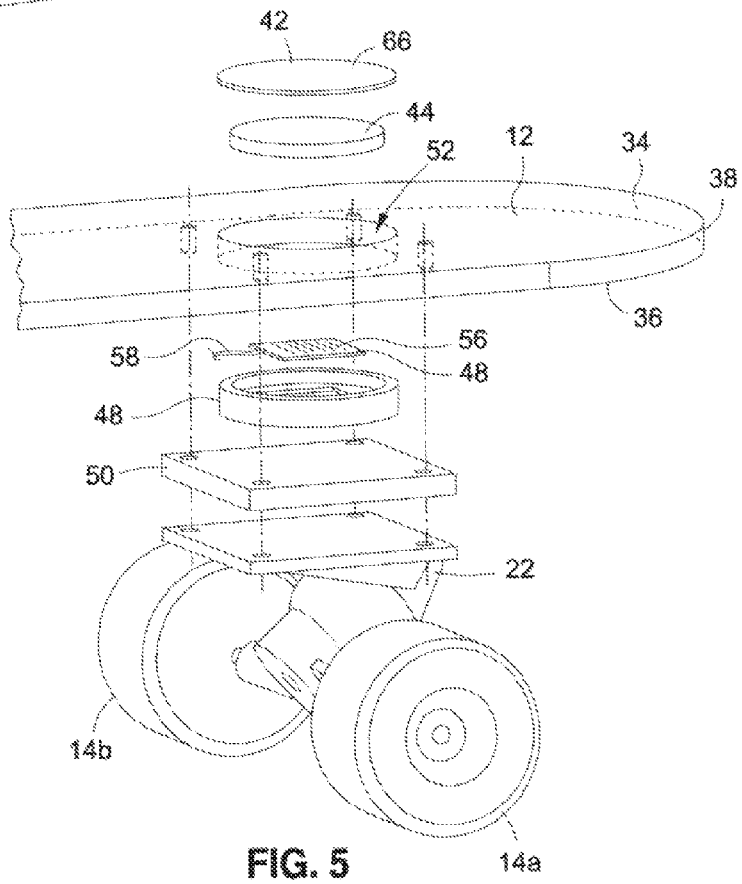
FIG. 5 is an exploded perspective view of a portion of the skateboard of FIG. 1 with the actuator assembly and a skateboard truck assembly and wheels.
Figure 6:
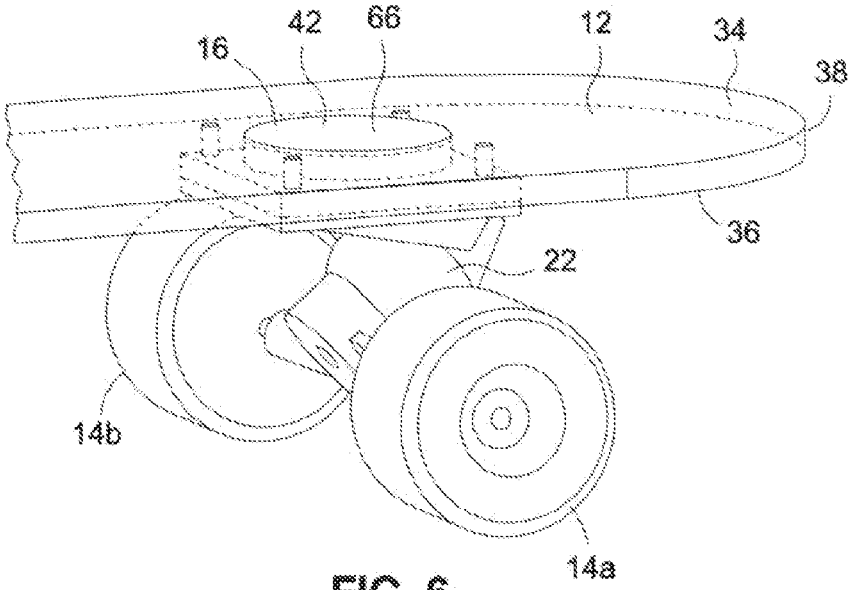
FIG. 6 is an assembled view of the portion of the skateboard of FIG. 5.
Figure 7:
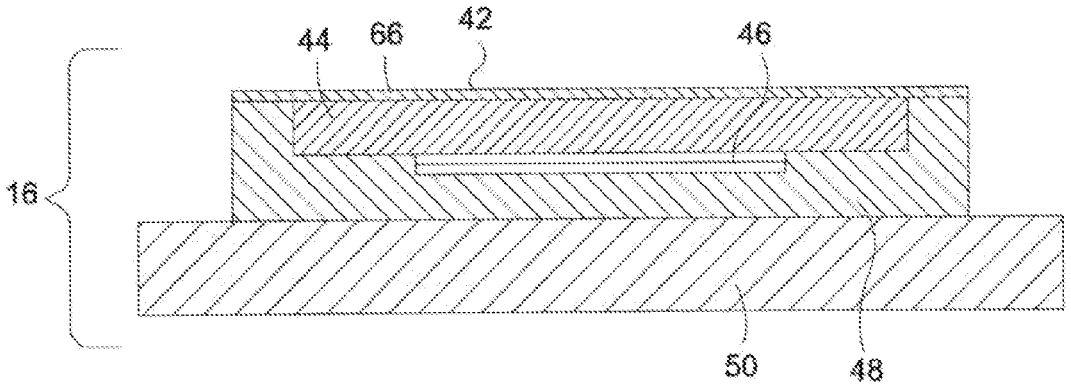
FIG. 7 is a side view of the actuator assembly.

Referring additionally to FIGS. 4-7, the first actuator assembly 16 will be further discussed. FIG. 4 is an exploded perspective view of the first actuator assembly 16. FIG. 5 is an exploded perspective view of a portion of the electric motorized skateboard 10 with the first actuator assembly 16, and FIG. 6 is an assembled view of the portion of the electric motorized skateboard 10. FIG. 7 is a side view of the first actuator assembly 16. In this embodiment, the first actuator assembly 16 includes a footpad 42, an actuator 44, a force sensor 46, actuator housing 48 and a spacer 50. The first actuator assembly 16 is attached to the skateboard deck 12 through the use of a deck opening 52 formed through the skateboard deck 12. Fasteners 54 are used to securely attach the first actuator assembly 16 to the skateboard deck 12.

In this embodiment, the first actuator assembly 16 and the deck opening 52 are particularly located adjacent the truck assembly 22. In this regard, the truck assembly 22 is attached to the spacer 50 with the first actuator assembly 16 and the truck assembly 22 being commonly attached to the skateboard deck 12 with the fasteners 54 adjacent to the deck bottom surface 36. The footpad 42 includes a footpad surface 66. The first actuator assembly 16 is positioned with the footpad surface 66 disposed adjacent the deck top surface 34. The footpad surface 66 may be substantially flat and disposed generally parallel to the deck top surface 66. The footpad surface 66 may be slightly raised in comparison to the deck top surface 66 so as to allow the rider 60 to recognized by touch or feel the exact location of the footpad 42.

According to an aspect of the present invention, there is provided the electric motorized skateboard 10. The electric motorized skateboard 10 further includes the skateboard deck 12 having the deck top surface 34 and the opposing deck bottom surface 36. The electric motorized skateboard 10 further includes a plurality of skateboard wheels (such as wheels 14*a-d*) disposed adjacent to the deck bottom surface 36. The electric motorized skateboard 10 further includes the first actuator assembly 16 attached to the skateboard deck 12. The first actuator assembly 16 includes the footpad 42 and the force sensor 46. The footpad 42 is generally disposed at the deck top surface 34. The footpad 42 and the force sensor 46 are cooperatively sized and configured to translate force applied to the footpad 42 to the force sensor 46. The force sensor 46 is sized and configured to output a sensed signal in response to the application of force upon the force sensor 46. The electric motorized skateboard 10 further includes the controller 68 in electrical communication with the force sensor 46. The controller 68 is sized and configured to receive the sensed signal and generate a motor input signal in response to the sensed signal. The electric motorized skateboard 10 further includes an electric motor 20 in mechanical communication with at least one of the skateboard wheels 14, such as skateboard wheel 14*c*. The electric motor 20 has a variable electric motor output in response to a value of a motor input signal received from the controller 68.

According to various embodiments, the electric motorized skateboard 10 may include the second actuator assembly 18. The second actuator assembly 18 may be constructed similarly as the first actuator assembly 16. It is contemplated that the electric motorized skateboard 10 may include additional actuator assemblies, as represented by actuator assembly 78 (as further denoted FSN) and disposed in electrical communication with the controller 68 via sensor conduit 80.

A power switch 32 may be provided. In the embodiment depicted, the power switch is located at the housing 26, and in particular adjacent the deck opening 52. This provides the user easy access while protecting the power switch 32 from accidental actuation. The power switch is disposed in electrical communication with the controller 68 for powering on and off the over all system.

Figure 9:
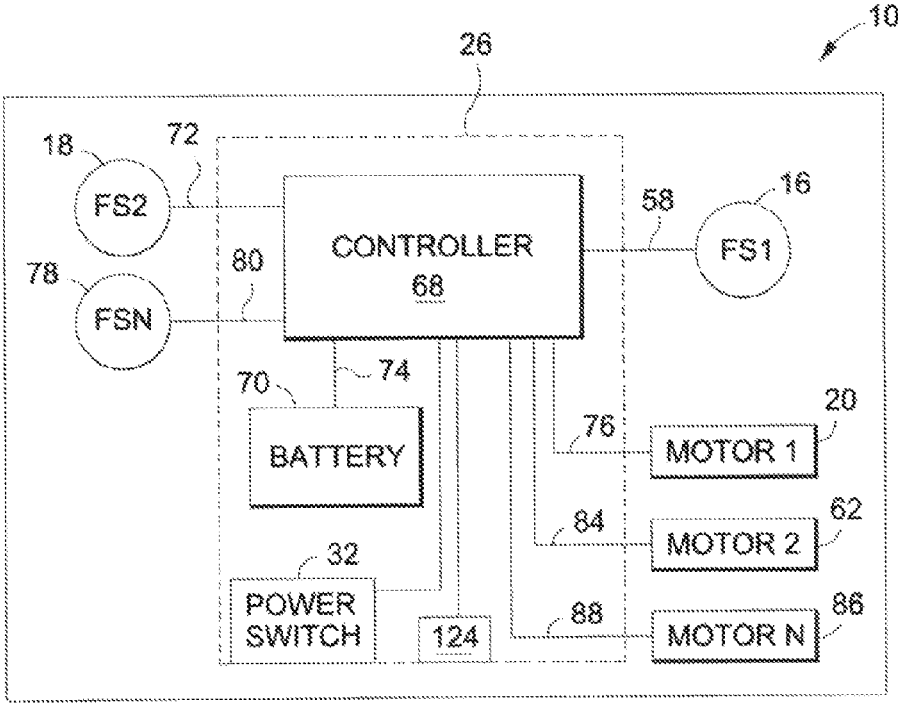
FIG. 9 is a symbolic schematic of the electric motorized skateboard.

With reference to the symbolic schematic of the electric motorized skateboard 10 of FIG. 9, the first actuator assembly 16 (further denoted as FS1) is disposed in electrical communication with the controller 68 via a sensor conduit 58. The second actuator assembly 18 (further denoted as FS2) is disposed in electrical communication with the controller 68 via a sensor conduit 72. The battery 70 is disposed in electrical communication with the controller 68 via a battery conduit 74. The electric motor 20 (further denoted as MOTOR1) is disposed in electrical communication with the controller via a motor conduit 76.

The force sensor 46 may include force-sensing resistors 56. It is contemplated, however, that the force sensor 46 may take the form of other types of sensors that are configured to detect the application of force, such as a piezoelectric sensor, load cell, a pressure transducer, or any other electro-mechanical sensor that can produce or modify a variable electrical signal by means of an applied force or force over an area (pressure). It is contemplated that force-sensing resistors are particular suited for this application taking into consideration the technology's optimal performance, thin design, and low cost. Force-sensing resistors 56 consist of a conductive polymer thick film device which exhibits a decrease in resistance with an increase in the force applied to the active surface. The film consists of both electrically conducting and non-conducting panicles suspended in a matrix. The particles are sub-micrometer sizes. Applying, a force to the surface of the sensing film causes particles to touch conducing electrodes, changing the resistance of the film. This change in resistance can be detected by the controller 68 as the sensed signal. It is contemplated that the controller 68 supplies a voltage to the force-sensing resistors 56. When a force input is provided, the returning input signal voltage (the sensed signal) may increase from an initial zero state to a maximum, although some resistive losses to heat may be seen. An example of a suitable sensor device for the force-sensing resistors 56 are those sensor products of Interlink Electronics, Inc. of Camarillo, Calif. and Sentronics of Bow, Wash.

The controller 68 accepts power from the battery 70. Voltage may vary depending on power or performance requirements. The controller 68 may be configured to monitor the voltage and current drawn from the attached battery 70 to monitor, provide rider feedback, and control the performance of the electric motorized skateboard 10 based on desired pattern set by a designer, manufacturer, vendor, rider, or other party. The electric motorized skateboard 10 may further include a power port 124 in operative communication with the controller 68 and the battery 70. The power port 124 is configured to be connectable with an external power source for recharging the battery 68. The power port 124 may be a USB port capable of receiving a USB connector for charging the battery 70. Other battery types and charging configurations may be selected from those well known to one of ordinary skill in the art. In this regard, the battery 70 may be removed from the housing 26 for recharging via a separate device. The recharging may also be performed by external, internal, or integrated outlet, AC or DC energy source, solar cells, regeneration of a motor during deceleration, regeneration of the electric motor 20 due to resisting external propagation, or other methods. The power port 124 may also serve the dual purpose of a communications port for programming the electric motorized skateboard 10. The power port 124 may be capable of receiving programming instructions from a programming device, such as a computer, smart phone, tablet computer or other programming devices known in the art.

The electric motorized skateboard 10 may include a handle 28 that may be cut into, inserted, attached or otherwise integrated with the skateboard deck 12 and/or the housing 26. In the embodiment of FIGS. 1-3, the handle 28 may be formed through the formation and placement of the handle opening 30. The handle 28 may be integrated with the skateboard deck 12 with the handle opening 30 being formed through the skateboard deck 12 and the housing 26. The handle 28 may serve as a way to pick up, turn over, carry, drag, roll, transport, or otherwise move the electric motorized skateboard 10. The handle 28 may also serve as a way to adequately secure to a movable or immovable object with a chain, rope, bike lock, or other method for security or loss prevention.

Figure 8A:
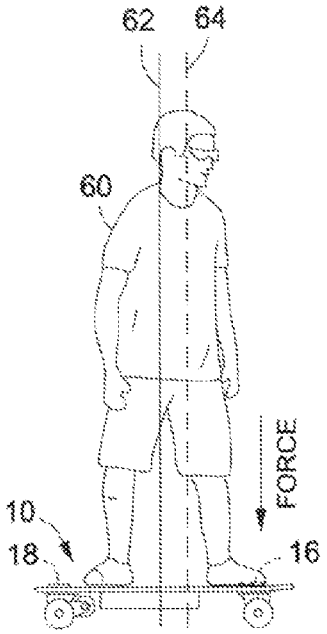
FIG. 8(*a*) is a symbolic illustration of a rider upon the electric motorized skateboard with the rider center of mass shifted forward.
Figure 8B:
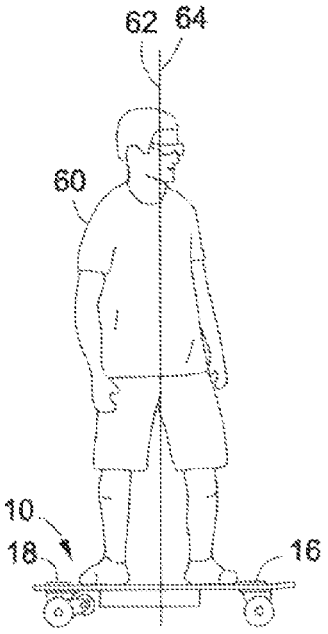
Figure 8C:
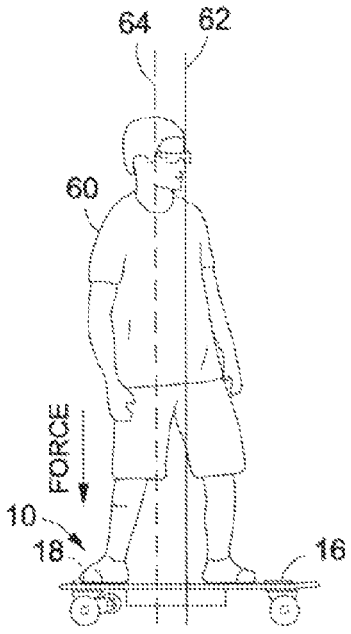

Referring now to FIGS. 8(*a*)-(*c*) there are depleted symbolic illustrations of a rider 60 upon the electric motorized skateboard 10. A rider center of mass 64 is depicted in relation to a skate board center line 62. In these illustrations, the direction of travel of the electric motorized skateboard 10 is to the right. In FIG. 8(*a*) the rider center of mass 64 is shifted forward, in FIG. 8(*b*) the rider center of gravity 64 is in a neutral position, and in FIG. 8(*c*) the rider center of mass 64 is shifted rearward.

It is contemplated that when one rides on or in a vehicle accelerating in a forward direction, one's center of gravity moves in the direction opposite the acceleration, relative to the vehicle. When standing, sitting, or otherwise situated on a vehicle or platform—for example a motorized skateboard—that begins accelerating forward, one's center of mass moves toward the rear in the moving reference frame, away from a position of centered balance. To compensate, there is a coordination element where one must transfer weight forward in the direction of acceleration in anticipation of the change in center of mass. An aspect of the present invention recognizes that by moving one's center of mass a distance forward equal to the rearward change in the location of center of mass that the acceleration would naturally cause, one remains properly balanced. This is true for forward deceleration (negative acceleration, or positive acceleration in the reverse direction) when a moving vehicle slows down. In that case, by moving one's center of mass a distance rearward equal to the forward change in the location of center of mass that the deceleration would naturally cause, one remains properly balanced.

An aspect of the invention further recognizes this dynamic nature, and intuitively simplifies the ability of one to maintain centered balance on the electric motorized skateboard 10 by using the force sensors 46 of the first and second actuator assemblies 16, 18 to initiate forward acceleration and deceleration. In an embodiment, the first actuator assembly 16 is disposed between the second actuator assembly 18 and the skateboard front end 38, and the second actuator assembly 18 is disposed between the first actuator assembly 16 and skateboard the rear end 40. In this design, the act of transferring weight forward onto the first actuator assembly 16 (such as depicted in FIG. 8(*a*)) in anticipation of acceleration actually causes the acceleration. Likewise, transferring weight rearward onto the second actuator assembly 18 (such as depicted in FIG. 8(*c*)) causes the deceleration for which that weight transfer is necessary to balance. In this action-reaction fashion, the use of the first and second actuator assemblies 16, 18 can be designed so that the weight transfer necessary for acceleration or deceleration is precisely tuned to cause an equal and opposite change in center of mass. "Acceleration" and "deceleration" can refer to the change is velocity of the electric motorized skateboard 10 as a result of the change in angular velocity of output shaft or rotor of the elector motor 20. It is contemplated that use of the first and second actuator assemblies 16, 18 provides an intuitive user-friendly interface for controlling the electric motorized skateboard 10 through the natural weight-shifting reflects of the rider 60. As such, the first actuator assembly 16 may be designated an "acceleration actuator assembly" and the second actuator assembly 18 may be designated a "deceleration actuator assembly."

The controller 68 may be configured such that transferring more weight forward onto the footpad 42, and therefore the force sensor 46 (of the first actuator assembly 16), will result in a greater amount of acceleration and result in a higher maximum velocity than transferring forward a lesser amount of weight onto the footpad 42. The controller 68 may be configured such that transferring more weight rearward onto the footpad 42, and therefore the force sensor 46 (of the second actuator assembly 18), will result in a greater amount of deceleration and result in reaching zero velocity faster than transferring rearward a lesser amount of weight onto the footpad 42.

It is contemplated that use of the first and second actuator assemblies 16, 18 makes controlling the electric motor 20 much easier and intuitive than by other methods. The electric motorized skateboard 10 is contemplated to reduce the physical requirements and learning curve present in motorized personal transportation, making the electric motorized skateboard 10 the easy way to learn to safely and properly control, by more effectively teaching fundamentals of balance, steering, speed management, and other control characteristics. The electric motorized skateboard 10 integrates the human action of force application (for example, by shift in weight) into infinite and variable control of the electric motor 20.

Although force may be primarily applied by a rider's feet onto the first and second, actuator assemblies 16, 18, the force controlling it can be applied by the foot, toe, hand, finger, wrist, elbow, tongue, teeth, or any other body part, extension of a body part, prosthesis, mechanical or pneumatic device, or anything else that can be used to apply force to a sensor that senses force or pressure by direct or indirect contact or stimulation, or any combination of the above, by one or more persons, depending on the application.

Acceleration rate may be determined by the voltage or change in voltage supplied to the electric motor 20 (in the form of the motor input signal received from the controller 68). At rest, zero volts may be supplied to the electric motor, or a voltage that results in the electric motor 20 moving at a speed of zero. To initiate acceleration, a voltage may be supplied to the electric motor 20 until the electric motor 20 reaches a desired speed, or a changing voltage may be supplied to the electric motor 20 so that the motor increases or decreases in speed at a desired rate. To continue or adjust acceleration or deceleration, a different voltage may be supplied to the electric motor 20 until the electric motor 20 reaches a new desired speed, or to continue or adjust acceleration or deceleration a different rate of change in voltage may be supplied to the electric motor 20 so that the electric motor 20 increases or decreases speed at a new desired rate. There may be a maximum acceleration value allowed for each speed or power of the electric motor 20, a universal maximum acceleration value for any speed or power of the motor, or a scalar or variable factor that may be changed to adjust acceleration values or maximum acceleration value(s) globally for some or all motor speeds or powers. These values, scalar values, and maximum values may determine voltage supplied to the electric motor 20 or current that the electric motor 20 may draw.

As mentioned above, the electric motor 20 has a variable electric motor output in response to a value of a motor input signal received from the controller 68. For example, increasing voltage supplied to the electric motor 20 (the motor input signal) by a small amount may cause the electric motor 20 to speed up or increase power a small amount, and increasing the voltage supplied to the electric motor 20 by a large amount may cause the electric motor 20 to speed up or increase power a large amount. For example, increasing voltage supplied to the electric motor 20 by a small amount may cause the electric motor 20 to increase in speed or power at a small rate, and increasing voltage supplied to the electric motor 20 by a large amount may cause the electric motor 20 to increase in speed or power at a large rate. For example, increasing the rate of increasing the voltage supplied to the electric motor 20 by a small amount may cause the electric motor 20 to increase speed or power at a small rate, and increasing the rate of increasing the voltage supplied to the electric motor 20 by a large amount may cause the electric motor 20 to increase speed or power at a large rate.

The controller programming may also result in the inverse of these acceleration characteristics may be true for deceleration. For example, decreasing voltage supplied to the electric motor 20 by a small amount may cause the motor to speed down or decrease power a small amount, and decreasing the voltage supplied to the electric motor 20 by a large amount may cause the electric motor 20 to speed down or decrease power by a large amount. For example, decreasing voltage supplied to the electric motor 20 by a small amount may cause the electric motor 20 to decrease in speed or power at a small rate, and decreasing voltage supplied to the electric motor 20 by a large amount may cause the electric motor 20 to decrease in speed or power at a large rate. For example, increasing the rate of decreasing the voltage supplied to the electric motor 20 by a small amount may cause the electric motor 20 to decrease speed or power at a small rate, and increasing the rate of decreasing the voltage supplied to the electric motor 20 by a large amount may cause the electric motor 20 to decrease speed or power at a large rate. There may be a maximum deceleration value allowed for each speed or power of the motor, a universal maximum deceleration value for any speed or power of the motor, or a scalar or variable factor that may be changed to adjust deceleration values or maximum deceleration value(s) globally for some or all motor speeds or powers. These values, scalar values, and maximum values may determine voltage supplied to the electric motor 20 or current the electric motor 20 may draw.

The motor output speed is contemplated to follow a predictable response curve with respect to applied across a spectrum of operating motor input signals for a specific model of the electric motor 20. This predictability allows for the calibration of the programing of the controller 68 with respect to correlating received sensed signals from the first and second actuator assemblies 16, 18 and the generated motor input signals. In addition, acceleration or deceleration may be controlled differently depending on the speed the electric motor 20 is moving. From a zero or minimum motor state, the amount or rate of increase in speed or power of a motor may be less than or greater than the amount or rate of increase in speed or power of a motor from the electric motor 20 speed greater than a zero or minimum motor state, for a given increase in the motor input signal.

The controller 68 is contemplated to be programmed with a response curve of the sensed signals to the motor input signal for achieving the desired motor output speed. As such the algorithm which governs the electric motor control may be modified through programming. Such programming may be preset or the controller 68 may be adapted to receive information to adjust or change such algorithms. In this respect, as mentioned above, the power port 124 may be capable of receiving programming instructions from a programming device, such as a computer, smart phone, tablet computer or other programming devices known in the art. The power port 124 is disposed in electrical communication with the controller 68.

In an embodiment, the controller 68 is configured to store at least two rider profiles, the controller is sized and configured to generate a motor input signal using a selected rider profile and the sensed signal(s). Such rider profiles may be created which allow for control over the acceleration, braking (deceleration), and coasting rate, among other factors and conditions of the electric motor 20 and the speed of the electric motorized skateboard 10. These rider profiles may allow for electronically controlled speed limits as well as a multitude of varied responses to the user input in the form of the sensed signals from any of the first and/or second actuator assemblies 16, 18. The acceleration and deceleration may be adjusted to respond in linear, logarithmic, stepwise, or other defined response curves. These may allow for multiple behaviors of the motor corresponding to predetermined performance profiles tailored to rider, application, model, or other criteria. Such profiles may include "beginner", "sport", "cruise", "extreme", and others. They may also be used to account for different user size, weight, physical limitation, personal preference, or other criteria so that operation and performance can be normalized for all users. They may be customized for specific applications, safety, or other reasons, such as speed regulation for children.

For example, a "beginner", "training", "learning", "safety", or other rider profile may have parameters designed for a rider that is new to electric motorized device. Such a rider profile may include a slower ramp up of the motor, lower maximum motor speed or power, faster ramp down of the motor, or reduced sensitivity of the motor response to sensed signal input. These factors may allow a rider's force input to cause reduced or more gradual initial acceleration of the electric motor 20, smoother transition to faster motor speeds, limit the motor from reaching an excessive speed, or slow or stop the electric motor 20 more quickly for the rider 60. Another rider profile may be designated as a "youth", "junior", "mini" or other profile may have parameters designed for a user that is smaller than average size. These may include a slower ramp up of the electric motor 20, lower maximum motor speed or power, or increased sensitivity of the motor response to sensed signal input. Because input to the controller 68 is based on force applied to its sensors (i.e., the force sensor 46), this rider profile may help a younger or smaller rider 60 to operate the electric motorized skateboard 10 as intended. It may allow a rider's force input to cause reduced or more gradual initial acceleration of the electric motor 20, smoother transition to faster motor speeds, limit the electric motor 20 from reaching an excessive speed, or amplify the motor response for force input received such that the range of effective force resembles the range of force the user may be capable of applying.

A rider profile designated as a "sport", "extreme", "touring", "pro", or other profile may have parameters designed for a rider 60 that is experienced with an electric motorized device and desires maximum performance. These may include faster ramp up of the motor, higher maximum motor speed or power, faster ramp down of the electric motor 20, increased sensitivity of the motor response to sensed signal input, or additional features or functionality. A rider profile designated as a "distance", "extended range", "green" or other profile may have parameters designed for a rider 60 to maximize distance travelled per charge of the battery 70, reduce impact on the environment, or otherwise improve energy efficiency. These may include slower ramp up of the electric motor 20, lower maximum motor speed or power, or slower ramp down of the electric motor 20. This rider profile may limit energy waste in accelerating, set maximum motor speed or power to a value at which the electric motor 20 operates with a desired efficiency, or prevent unnecessary reduction in speed when braking to maintain momentum or improve regenerative efficiency. Another rider profile may be designated as a "classic" profile may have parameters designed for a rider 60 of average size and ability operating under average operational conditions.

The rider profiles may be adjusted by the rider 60, allowing the electric motorized skateboard 10 to be adapted for different riders 60, or personalized to a particular performance and response specification. The rider profiles may allow additional features to be added and controlled, for example constant speed (cruise control), manipulation of external accessories such as speakers or lighting, or user feedback of battery level, speed, distance, or other data through display of color, sound, readout, or communication with another external or internal device.

The algorithm may be programmed in such a way that its variables can be easily modified and updated from a connected or remote device. This may be a personal computer, handheld programming device, mobile device such a smartphone or tablet, or other device. Programming that controls or affects communication, interaction, or effect of or between components of the controller 68 may be burned, loaded, boot-loaded, stored, or otherwise present in a processor, cache, bus, permanent, memory, temporary memory, RAM, ROM, EEPROM, or other microchip or electro-mechanical component or virtual aspect of the electronics of the controller 68 in digital or analog form, as well as stored or modified externally. For example, processing may be performed by a microcontroller boot-loaded for a high-level programming language such as C++, with editable values stored and referenced separately in EEPROM memory. Communication may be performed by wire such as USB, by Bluetooth, by RFID identification, or other method. Performance data such as speed, location, distance, voltage, current, input values and characteristics, and a multitude of derived values such as riding style, energy usage, carbon footprint, and service recommendations, as well as others, may be monitored or communicated. The controller 68 may allow for individual or collective change of such parameters affecting performance and user feedback. The controller 68 may also allow for control of attached electronics, for example, LED headlights, two-stage brake lights, speed sensors, RFID identification for on/off control, battery level indication, and others such accessories.

Without sensor input of the sensed signals, the controller 68 may be programmed to simulate the electric motor 20 being virtually disengaged from the drive system to the wheel(s) 14. The physical connection may remain unaltered, and motor conditions may continue to be monitored to determine vehicle speed and other information. The electric motor 20 may be quickly and seamlessly virtually-reconnected to accelerate or decelerate when sensed signals are received from the first and second actuator assemblies 16, 18. This is considered a "cruise" or neutral condition, allowing the electric motorized skateboard 10 to behave as if it does not have an electric motor 20 when no input is being received. This may result in the electric motorized skateboard 10 being able to roll for prolonged distances when already in motion, or to be pushed manually, behaving in the same manner as if were a non-motorized skateboard.

This coasting feature has many benefits, including a natural movement rider experience. Some of the appeal of skateboards featuring a motor is the "feel" of operation, which includes a slow, natural deceleration due to friction. The neutral coast condition of the ICS may simulate this, allowing it to appeal to a broader audience of riders. Neutral coasting may allow the electric motor 20 to spin longer and the electric motorized skateboard 10 to cover a longer distance before coming to a stop. Neutral coasting may also allow a rider 60 the opportunity to push a vehicle up to speed, and then maintain or adjust that speed with input to the controller 68. The coasting control scheme may reduce the difficulty to operate the electric motorized skateboard 10. For example, many people who want to skateboard do not because they have too much difficulty learning to properly balance. Although external propulsion such as manual pushing may not be necessary when the electric motor 20 is controlled by the controller 68, the coast condition may allow riders 60 to do so if it is desired, and in doing so learn and practice the fundamentals of operation. For example, this may make it easier to learn to skateboard, and learn fundamentals of other board sports including snowboarding, wakeboarding, surfing, and others.

It is contemplated that the algorithm or programming of the controller may have four primary conditions for the electric motor 20. In a first condition where only a sensed signal is being received from the first actuator assembly 16, the motor input signal may correspond to the motor speed to which the signal equates in the algorithm. Minimum value of the sensed signal may equate to minimum forward stimulation of the electric motor 20, and maximum value of the sensed signal may equate to full forward stimulation of the electric motor 20, while the signal range in between may equate to partial forward stimulation of the electric motor 20. In a second condition where only a sensed signal is being received from the second actuator assembly 18, then the motor input signal may correspond to the electric motor 20 being allowed to slow at the rate to which the signal equates in the algorithm. A minimum sensed signal may equate to minimum deceleration of the electric motor 20, and maximum sensed signal may equate to full deceleration of the electric motor 20, while the sensed signal range in between may equate to partial deceleration of the electric motor 20. In a third condition where both of the first and second actuator assemblies 16, 18 are producing sensed signals as received by the controller 68, the sensed signal from the second actuator assembly 18 (a signal to "decelerate") may be given preference. The sensed signal from the first actuator assembly may be ignored or its effect may be otherwise modified, depending on programming of the rider profile. In a fourth condition, if no sensed signals are being detected by the controller 68, the electric meter 20 may be put in a neutral cruise condition as discussed above.

As indicated above the first and second actuator assemblies 16, 18 each include the footpad 42, the actuator 44, the force sensor 46, the actuator housing 48 and the spacer 50. It is contemplated that these components may be integrated with other components, including the skateboard deck 12, the truck assemblies 22, 24, and even the drive train components of the electric motor 20. For example, it is contemplated that the spacer 50 may be integrated with the skateboard deck 12 or the truck assemblies 22, 24. The actuator housing 48 and the spacer 50 may be integrated into a single unitary piece.

The footpad 42 may consist of a layer of semi-rigid plastic or vinyl material adhered to the upper surface of the actuator housing 48 and positioned above the top of the actuator 44. The footpad 42 may act to protect the actuator 44, and may help evenly distribute force over the force sensor 46. The footpad 42 may have a variety of shapes and thicknesses depending on design requirements, and may be wrapped or covered in material with desirable grip and aesthetic properties.

The actuator 44 may be a force-dispersing layer within the actuator housing 48 above the force sensor 46. Actuator 44 is configured to evenly distribute force applied to its upper surface onto the force sensor 46 positioned below. When no force input is applied, a small gap may exist between the force sensor 46 and the bottom surface of the actuator 44 so that the actuator 44 does not make physical contact with the force sensor 46. When force is applied, the actuator 44 may deform in an "elastic" manner, making contact and evenly distributing the force over the force sensor 46. Elastic in this context refers to a material that returns to its original position and shape when force is removed. The actuation system may absorb a portion of the force input applied while evenly distributing the remaining force over an area of the force sensor 46, so that the resulting range of pressure may be more easily manipulated by the rider 60 upon the footpad surface 66. This design may allow input force to be applied to the force sensor 46 in a substantially linear, vertical manner for repeatability.

The actuator 44 may use a soft, deformable, nonabrasive material in the actuation system to prolong sensor life. It is contemplated that the various components, material selection, geometry and configuration of the first and second actuator assemblies 16, 18 may be chosen from those which are well known to one of ordinary skill in the art.

It is further contemplated that the actuator 44 may be non-uniform in shape and/or material so as to result in various portions across the top surface of the actuator 44 may be more or less "sensitive" with respect to translating force to the force sensor 46. This may be utilized to compensate for riders 60 with varying weights, shoe size, footwear styles, and other variable factors may choose a position that best suits them. The center of the sensing area of the actuator 45 may be most sensitive to applied force, while the edges may be least sensitive, so different placements of force may provide different performance characteristics.

As indicated above, an aspect of the present invention includes an electric motorized skateboard 10 with the first actuator assembly 16 (i.e., just a single force-sensor embodiment for providing "acceleration" sensed signals). As also indicated above, another aspect of the present invention includes an electric motorized skateboard 10 with the first and second actuator assemblies 16, 18 (i.e., a two force sensor embodiment that can be programmed for providing both "acceleration" and "deceleration" sensed signals). Numerous benefits and advantages with respect to operation and control of such a configuration are detailed above.

It is contemplated that the electric motorized skateboard 10 may include more than two actuator assemblies, such as another actuator assembly, the actuator assembly 78 indicated in the schematic diagram of FIG. 9. The actuator assembly 78 is further denoted as "FSN" with "FS" referring the force sensor 46 within and "N" referring symbolically to any number of actuator assemblies 78. In this regard, it is contemplated that the electric motorized skateboard 10 may include a multitude of actuator assemblies. Moreover, is it further contemplated that a given actuator assembly (such as the first actuator assembly 16) may include more than one force sensor 46 with each generating sensed signals as detected by the controller 68.

The actuator assemblies, such as the first and second actuator assemblies 16, 18, may be located near or above the truck assemblies 22, 24 for a number of benefits. In general by locating the first and second actuator assemblies 16, 18 near or above the point of contact with the ground, the weight of the rider 60 may more effectively be transferred to the ground during operation, including acceleration and deceleration, when the rider's weight may be most unevenly distributed on the electric motorized skateboard. Near or above the point of contact with the ground may provide a stronger and more consistent foundation for force sensing. If the first and second actuator assemblies 16, 18 are positioned elsewhere, the first and second actuator assemblies 16, 18 may be more susceptible to flex, torque, amplified vibration, or other inconsistencies.

Figure 10:
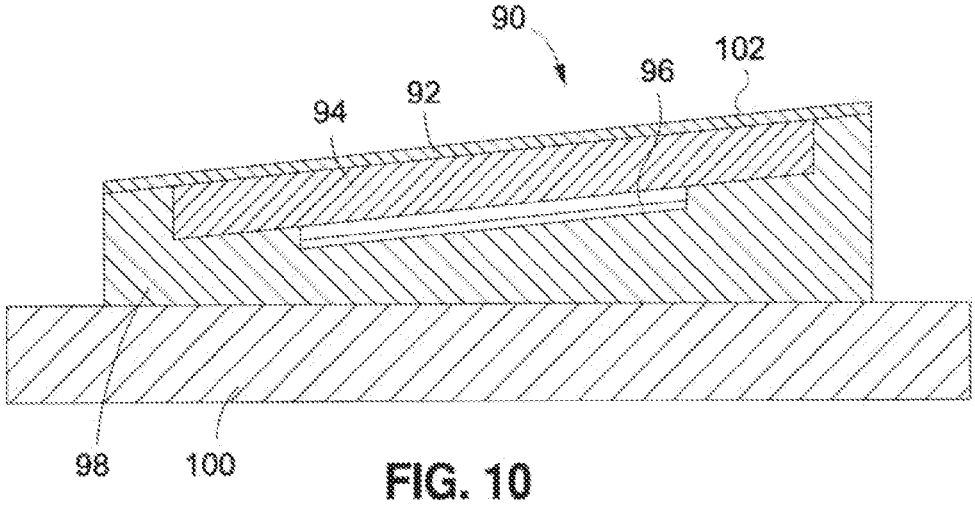
FIG. 10 is a side view of an actuator assembly according to another embodiment.
Figure 11:
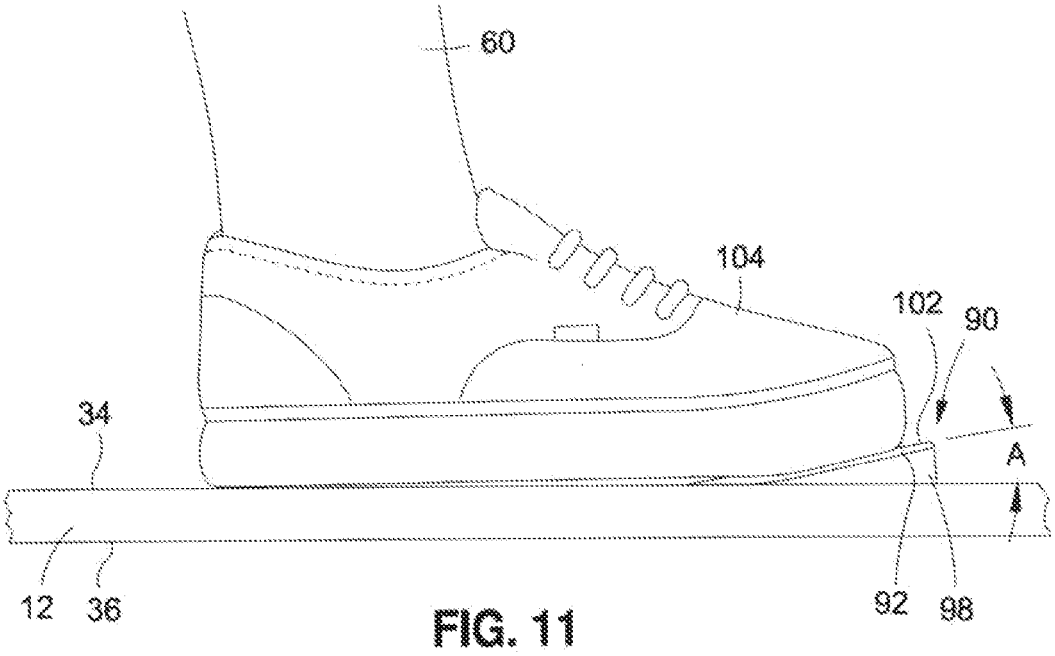
FIG. 11 is a side view of a portion of a skateboard with the actuator assembly of FIG. 10 as depicted with a rider's foot/shoe.
Figure 12:
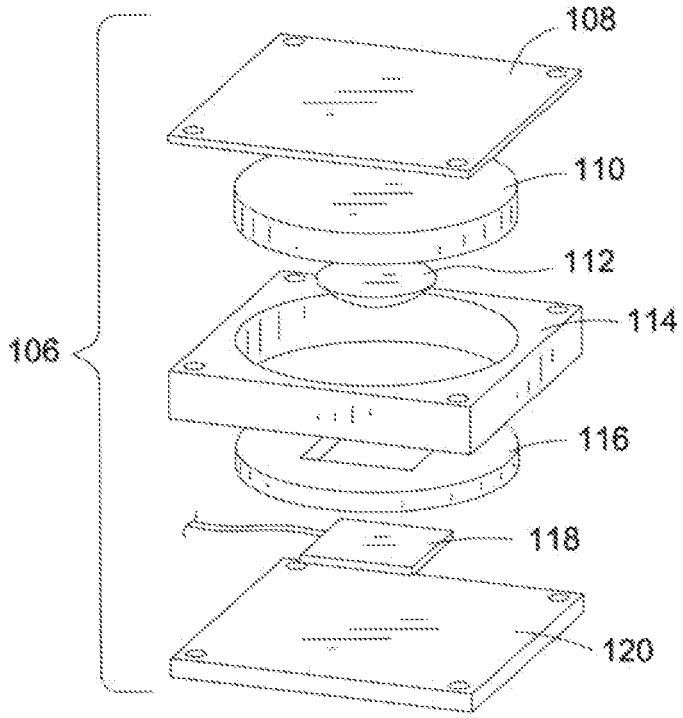
FIG. 12 is an exploded perspective view of an actuator assembly according to another embodiment.
Figure 13:
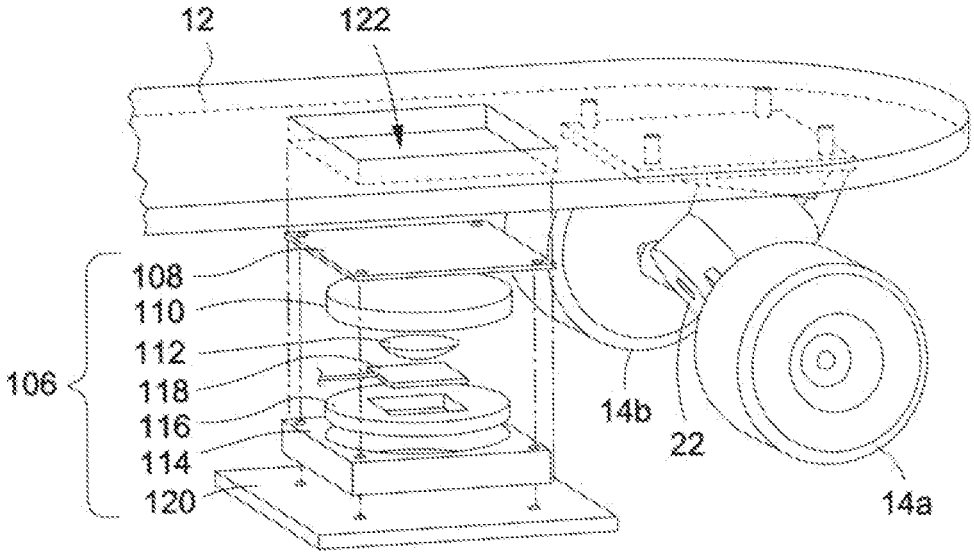
FIG. 13 is an exploded perspective view of a portion of a skateboard according to another embodiment with the actuator assembly of FIG. 12.
Figure 14:
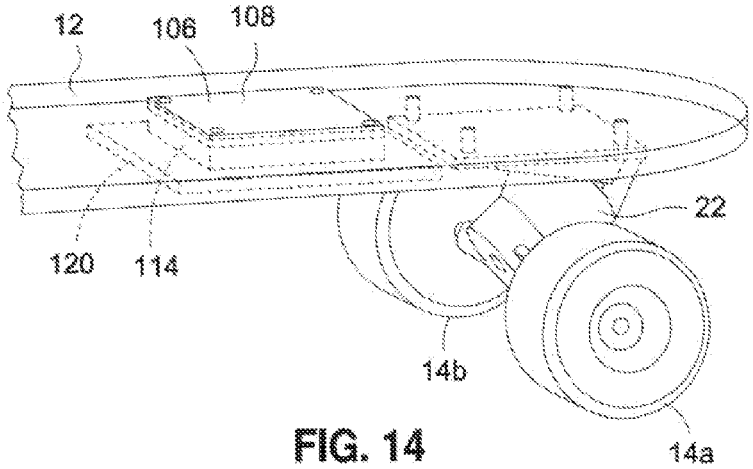
FIG. 14 is an assembled view of the portion of the skateboard of FIG. 13.
Figure 15:
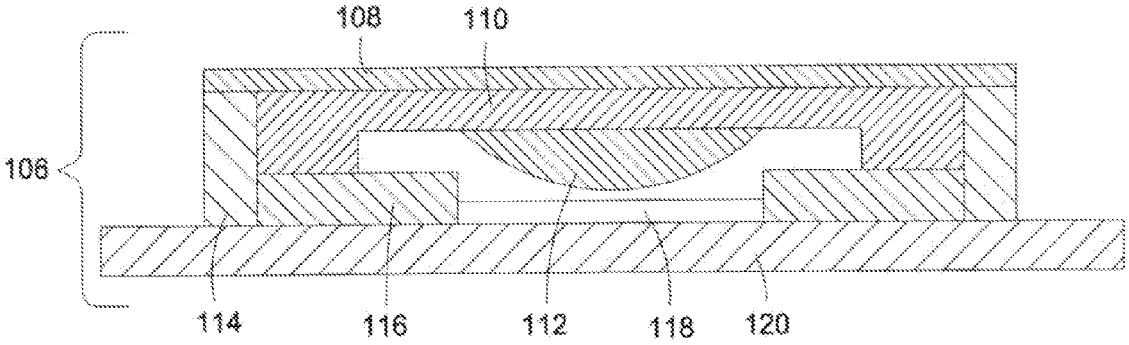
FIG. 15 is a side view of the actuator assembly of FIG. 12.

Referring now to FIG. 10, there is depicted a side view of an actuator assembly 90 according to another embodiment. In this regard, the actuator assembly 90 may be used to replace the first actuator assembly 16 discussed above. The actuator assembly 90 includes a footpad 92 with a footpad surface 102. FIG. 11 is side view of a portion of the electric motorized skateboard 10 with the actuator assembly 90 as shown in relation to a foot/shoe 104 of the rider 60. The foot pad surface 102 is substantially flat and is disposed at an angle (denoted "A") with respect to the deck top surface 34. The footpad surface 104 may be configured to taper away from the deck top surface 34 towards the skateboard front end 38 (to the right in the view of FIGS. 10 and 11). It is contemplated that such angulation allows the rider 60 to more easily, comfortably and controllably maintain his/her rider center of mass 64 in closer proximity to the skateboard centerline 62. The actuator assembly 90 may further include an actuator 94, a force sensor 96, an actuator housing 98, and a spacer 100. These components are configured similarly to the actuator 44, the force sensor 46, the actuator housing 48, and the spacer 50 as described above. However, these components are configured with the angled geometry to as to maintain the footpad surface 102 in the tapper configuration as depicted. The actuator assembly 90 may also be used to replace the second actuator assembly 18 discussed above, provided the actuator assembly 90 is installed so as to tapper away from the deck top surface 34 towards the skateboard rear end 40.

Referring now to FIGS. 12-15, there is depicted an actuator assembly 106 according to another embodiment. The views of FIGS. 12-15 are similar to those of FIGS. 4-7. Like reference numerals indicate like structures. Thus, similar referenced structures are as described above, but with those differences noted. The actuator assembly 106 includes a footpad 108, an actuator 110, a force applicator 112, an actuator housing 114, a correcting ring 116, a force sensor 118, and a baseplate 120. The skateboard deck 12 includes a deck opening 122 sized and configured to receive the actuator assembly 106. In this regard, the actuator assembly 106 is positioned rearward from the mounting position of the truck assembly 22.

The footpad 108 may be constructed similar to the footpad 42. However, in this embodiment, the footpad 108 is of a rectangular configuration. The actuator 110 may be constructed similar to the actuator 44, and the force sensor 118 may be similarly constructed as the force sensor 46.

The force applicator 112 may be a single or multiple-layer element that is configured to translate force applied to its upper surface to a force sensor below it. The force applicator 112 may also function to disperse that force evenly on the force sensor 118. When force is applied, the force applicator 112 may translate and may deform in an "elastic" manner, making contact and evenly distributing force over the force sensor 118. There may be a force applicator 112 attached to or integrated into the bottom of the actuator 110 that has a smaller surface area than the actuator 110 so that force may be concentrated in a targeted location. This design may allow a variety of sensors in a variety of positions and arrangements to be used more effectively. The force applicator 112 may be made of a deformable, nonabrasive material, chosen in a shape and hardness suited for its intended use. The force applicator 112 may be round or hemispherical, or otherwise have a base radius equal to or greater than its tip. As input force increases, the tip of the force applicator 112 may contact the force sensor 118, then compresses and expand, applying a greater force over a greater surface area. This may increase pressure more evenly over the force sensor 118.

The actuator housing 114 may be a round, square, or other shape component of or addition to the baseplate 120 that may surround the actuator and structurally reinforce it. The actuator 110 may directly or indirectly attach to an upper surface of the actuator housing 114, which may have a height greater than the actuator 110 such that a void exists between the actuator 110 and force sensor 118 when no force is being applied to the actuator 110. The correcting ring 116 includes a cutout or recess form-fit to the force applicator 112 so as to facilitate and maintain consistent linear actuation of the force applicator 112 upon the force sensor 118. It may be a feature of the base plate or actuator housing. It may be shaped and positioned to aid proper actuator alignment before engagement of the force applicator 112 with the force sensor 118, and maintain proper alignment and even force distribution after engagement. This may reduce or prevent shear, improve repeatability, and extend component life. Depending on material of the force applicator 112, the correcting ring 116 may function to tune the vertical position of the force actuator 112, or limit the range of actuation to prevent excessive pressure on the force sensor 118. The baseplate 120 may be a firm surface to which the force sensor 1118 adheres, and may function as a structural foundation for the actuator assembly 106.

Referring to symbolic schematic of FIG. 9, the electric motorized skateboard 10 may include an electric motor 82 (further denoted as MOTOR2) is disposed in electrical communication with the controller 68 via a motor conduit 84, and an electric motor 86 (further denoted as MOTORN) is disposed in electrical communication with the controller 68 via a motor conduit 88. The electric motor 86 is denoted with the "N" referring symbolically to any number of electric motors 86. In this regard, it is contemplated that the electric motorized skateboard 10 may include a multitude of electric motors. For example, each of the wheels 14*a-d* may have a dedicated electric motor attached to it. It is contemplated that the controller 68 may be configured to generate multiple simultaneous motor input signals to any attached electric motor.

When a motorized vehicle is in motion, the drive wheel 14*c* may be directly connected to fire electric motor 20, causing the electric motor 20 to turn due to the momentum of the electric motorized skateboard 10 (with and/or without including its rider 60). The electric motor 20 may therefore act as a generator when decelerating, known as "dynamic braking". For a moving motor, current may flow opposite the direction of travel during braking/deceleration, which exerts a torque that opposes forward travel. The electrical power this releases is dissipated as heat (rheostatic braking), recovered and returned to the battery 70 (regenerative braking), or both. Braking may also be achieved by reverse stimulation of the motor, as well as by other methods. For example, permanent magnet motors may be decelerated by shorting the motor leads directly, bringing the electric motor 20 to an abrupt stop and dissipating the electrical power as heat within the electric motor 20 itself, or by connecting them through a resistor or resistive element, bringing the electric motor 20 to a delayed stop (depending on resistive element) and dissipating the electrical power as heat in the electric motor 20 and resistive element. Thermal monitoring may be present to safeguard the electric motor 20 and controller 68 against overheating. By these and other means, the ICS may not require any mechanical brake to decelerate the electric motor 20 (and therefore the electric motorized skateboard 10), and eliminating or reducing the wear on friction-based braking component if they are present. It may also lower net energy consumption of the system with regeneration. For regeneration, a motor in motion acts as a generator, and the energy created by it may be measured, captured, stored, redirected, or otherwise utilized to improve system efficiency or performance.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. An electric motorized skateboard comprising:

a skateboard deck having a deck top surface and an opposing deck bottom surface;

a plurality of skateboard wheels disposed adjacent to the deck bottom surface;

a first actuator assembly attached to the skateboard deck, the first actuator assembly including a footpad and a force sensor, the footpad being generally disposed at the deck top surface, the footpad and the force sensor being cooperatively sized and configured to translate force applied to the footpad to the force sensor, the force sensor being sized and configured to output a sensed signal in response to application of force upon the force sensor;

a second actuator assembly attached to the skateboard deck, the second actuator assembly including a second footpad and a second force sensor, the second footpad being generally disposed at the deck top surface separated from the footpad with a portion of the skateboard deck being exposed there between, the second footpad and the second force sensor are cooperatively sized and configured to translate force applied to the second footpad to the second force sensor, the second force sensor being sized and configured to output a sensed signal in response to application of force upon the second force sensor;

a controller in electrical communication with the force sensor and the second force sensor, the controller being sized and configured to receive the sensed signals and generate a motor input signal in response to the sensed signals; and an electric motor in mechanical communication with at least one of the skateboard wheels, the electric motor having a variable electric motor output in response to a value of a motor input signal received from the controller.

2. The electric motorized skateboard of claim 1 wherein the force sensor includes force-sensing resistors, the footpad and the force-sensing resistors are cooperatively sized and configured to translate force applied to the footpad to the force-sensing resistors, the force sensor is sized and configured to output a sensed signal in response to application of force upon the force-sensing resistors.

3. The electric motorized skateboard of claim 1 wherein the electric motor is a DC motor.

4. The electric motorized skateboard of claim 1 wherein the motor input signal is a variable voltage signal.

5. The electric motorized skateboard of claim 1 wherein the footpad includes a substantially flat foot pad surface, the footpad surface is generally parallel with the deck top surface.

6. The electric motorized skateboard of claim 1 wherein the footpad includes a substantially flat foot pad surface, the footpad surface is disposed at an angle with respect to the deck top surface.

7. The electric motorized skateboard of claim 6 wherein the skateboard deck has a skateboard front end and a skateboard rear end, the footpad surface tapers away from the deck top surface towards the skateboard front end.

8. The electric motorized skateboard of claim 1 wherein the skateboard deck has a skateboard front end and a skateboard rear end, the first actuator assembly is disposed between the second actuator assembly and the skateboard front end, the second actuator assembly is disposed between the first actuator assembly and the skateboard rear end.

9. The electric motorized skateboard of claim 1 wherein the plurality of skateboard wheels includes a pair of front skateboard wheels, the motorized skateboard further includes a skateboard truck with the front skateboard wheels attached to the skateboard truck, the skateboard truck is attached to the first actuator assembly.

10. The electric motorized skateboard of claim 1 wherein the controller is configured to store at least two rider profiles, the controller is sized and configured to generate a motor input signal using a selected rider profile and the sensed signal.

11. The electric motorized skateboard of claim 1 wherein the electric motor is a first electric motor, the electric motorized skateboard further includes a second electric motor in mechanical communication with at least another one of the skateboard wheels, the second electric motor having a variable electric motor output in response to a value of a motor input signal received from the controller.

12. The electric motorized skateboard of claim 11 wherein the controller is sized and configured to receive the sensed signal and respectively generate first and second motor input signals in response to the sensed signal, the first electric motor is configured to receive the first motor input signal, the second electric motor is configured to receive the second motor input signal.

13. An electric motorized skateboard comprising:

a skateboard deck having a deck top surface and an opposing deck bottom surface;

a plurality of skateboard wheels disposed adjacent to the deck bottom surface;

a first actuator assembly attached to the skateboard deck, the first actuator assembly including a footpad and a force sensor, the force sensor including force-sensing resistors, the footpad being generally disposed at the deck top surface, the footpad and the force-sensing resistors being cooperatively sized and configured to translate force applied to the footpad to the force-sensing resistors, the force sensor being sized and configured to output a sensed signal in response to application of force upon the force-sensing resistors;

a second actuator assembly attached to the skateboard deck, the second actuator assembly including a second footpad and second force-sensing resistors, the second footpad being generally disposed at the deck top surface separated from the footpad with a portion of the skateboard deck being exposed there between, the second footpad and the second force-sensing resistors are cooperatively sized and configured to translate force applied to the second footpad to the second force-sensing resistors, the second force-sensing resistors being sized and configured to output a sensed signal in response to application of force upon the second force-sensing resistors;

a controller in electrical communication with the force-sensing resistors and the second force-sensing resistors, the controller being sized and configured to receive the sensed signals and generate a motor input signal in response to the sensed signals; and an electric motor in mechanical communication with at least one of the skateboard wheels, the electric motor having a variable electric motor output in response to a value of a motor input signal received from the controller.

14. An electric motorized skateboard comprising:

a skateboard deck having a deck top surface and an opposing deck bottom surface;

a plurality of skateboard wheels disposed adjacent to the deck bottom surface;

an acceleration actuator assembly attached to the skateboard deck, the acceleration actuator assembly including a footpad and a force sensor, the footpad being generally disposed at the deck top surface, the footpad and the force sensor being cooperatively sized and configured to translate force applied to the footpad to the force sensor, the force sensor being sized and configured to output a sensed acceleration signal in response to application of force upon the force sensor;

a deceleration actuator assembly attached to the skateboard deck, the deceleration actuator assembly including a second footpad and a second force sensor, the second footpad being generally disposed at the deck top surface separated from the footpad with a portion of the skateboard deck being exposed there between, the second footpad and the second force sensor being cooperatively sized and configured to translate force applied to the second footpad to the second force sensor, the second force sensor being sized and configured to output a sensed deceleration signal in response to application of force upon the second force sensor;

a controller in electrical communication with the force sensors, the controller being sized and configured to receive the sensed acceleration signal and the sensed deceleration signal and generate a motor input signal in response to the sensed acceleration signal and the sensed deceleration signal; and an electric motor in mechanical communication with at least one of the skateboard wheels, the electric motor having a variable electric motor output in response to a value of a motor input signal received from the controller.

15. The electric motorized skateboard of claim 14 wherein the skateboard deck has a front end and a rear end, the acceleration actuator is disposed between the deceleration actuator and the front end, the deceleration actuator is disposed between the acceleration actuator and the rear end.

* * * * *